US006494963B1

(12) United States Patent
Holly

(10) Patent No.: US 6,494,963 B1
(45) Date of Patent: Dec. 17, 2002

(54) SCRAPING TOOL AND METHOD FOR ITS USE

(75) Inventor: Kennith P. Holly, Bentonville, AR (US)

(73) Assignees: Ronald D. Fowler, Springdale, AR (US); Michael D. Daniels, Springdale, AR (US)

( * ) Notice: Subject to any disclaimer, the term of this patent is extended or adjusted under 35 U.S.C. 154(b) by 0 days.

(21) Appl. No.: 09/977,109

(22) Filed: Oct. 12, 2001

Related U.S. Application Data

(60) Provisional application No. 60/239,585, filed on Oct. 12, 2000.

(51) Int. Cl.[7] ..... A47L 13/08; B08B 1/00

(52) U.S. Cl. ..... 134/6; 15/236.05; 15/236.06; 15/236.09; 30/172

(58) Field of Search ..... 15/236.05, 236.06, 15/236.07, 236.09, 104.03, 104.31, 104.066, 104.068, 235.3, 235.7; 30/172; 134/6

(56) References Cited

U.S. PATENT DOCUMENTS 895,097 A 8/1908 Lucas
2,194,095 A * 3/1940 Noss
2,380,186 A * 7/1945 Mayer
2,535,253 A 12/1950 Anderson
4,207,674 A 6/1980 Heronema
4,679,275 A 7/1987 Shannon
5,491,862 A * 2/1996 Hurley
5,606,761 A 3/1997 Lynch
5,823,592 A 10/1998 Kalidindi
5,908,644 A * 6/1999 Poole
6,101,663 A 8/2000 Greer, Jr. et al.

* cited by examiner

*Primary Examiner*—Randall E. Chin
(74) *Attorney, Agent, or Firm*—William R. Sharp

(57) ABSTRACT

A scraper head of a scraping tool includes (i) a base having a longitudinal axis, longitudinally opposing first and second ends, and an interior threaded surface defining a longitudinally extending cavity within the base, the cavity having an open end at the first base end and a closed end within the base, and (ii) a pair of blades extending from the second base end so as to terminate in respective end portions which converge to a tip aligned with the base axis. The cavity in the base of the scraper head can threadedly and securely receive the threaded end portion of an extension pole. In use, the tip of the scraper head is positioned at the junction between a textured ceiling and a wall, and the scraper head is moved with the extension pole along the junction such that the blade end portions cut away excess texture material. A straight line is created at the junction in preparation for painting of the wall.

13 Claims, 2 Drawing Sheets

SCRAPING TOOL AND METHOD FOR ITS USE

CROSS-REFERENCE TO RELATED APPLICATIONS

This application claims the benefit of U.S. Provisional Application No. 60/239,585, filed Oct. 12, 2000.

BACKGROUND OF THE INVENTION

The invention relates to a scraping tool, and more particularly to a tool for scraping texture material from and along the junction between a ceiling and wall.

Texture material is often applied to ceilings. The texture material creates an irregular surface that effectively hides seams and enhances the appearance of the ceiling. Acoustic texture material contains particles which offer the additional advantage of sound absorption.

Application of texture material to a ceiling can, however, create an irregular line along the junction between the ceiling and a wall such an irregular line is not aesthetically pleasing, and also makes it difficult and tedious to paint the wall along the line.

SUMMARY OF THE INVENTION

It is, therefore, an object of the invention to provide a tool that can be used to scrape along the junction between a textured ceiling and wall, and create a straight line at such junction without damaging either the wall or ceiling.

The above object is realized by a tool comprising a scraper head which includes (i) a base having a longitudinal axis, longitudinally opposing first and second ends, and an interior threaded surface defining a longitudinally extending cavity within the base, the cavity having an open end at the first base end and a closed end within the base, and (ii) a pair of blades extending from the second base end so as to terminate in respective end portions which converge to a tip aligned with the base axis.

According to another aspect of the invention, there is provided a method of scraping excess texture material from and along the junction between a textured ceiling and a wall, comprising: providing a scraping tool comprising the above-described scraper head and an extension pole having an externally threaded end portion threadedly received in the cavity within the base of the scraper head; positioning the tip of the scraper head at the junction between the ceiling and wall, with the end portion of one blade being adjacent to the ceiling and the end portion of the other blade being below said one blade and adjacent to the wall; and moving the scraper head with the extension pole in a direction parallel to and along the junction between the ceiling and wall, whereby the end portions of the blades cut away excess texture material to create a straight line at the junction.

DETAILED DESCRIPTION OF THE INVENTION

Figure 1:
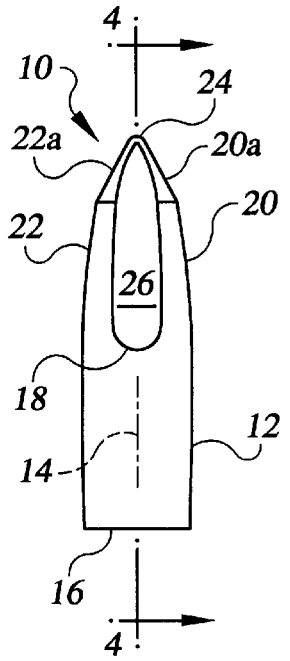
FIG. 1 is a side view of a preferred embodiment of the scraper head.
Figure 7:
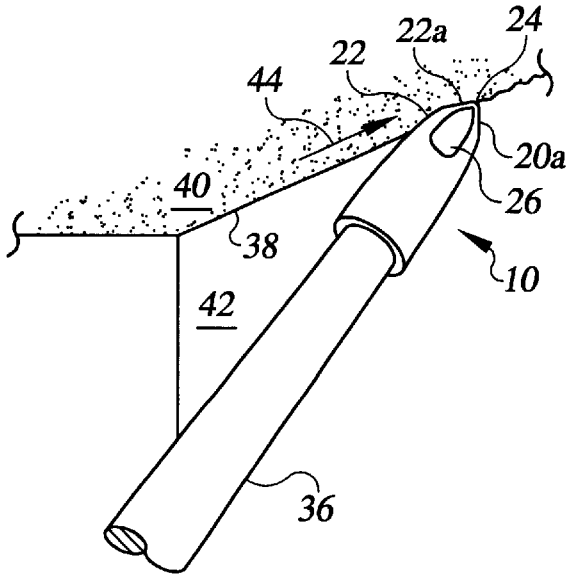
FIG. 7 is a view of the scraping tool, comprising the extension pole and scraper head secured thereto, in use along the junction between a textured ceiling and a wall.

Referring to FIG. 1, scraper head 10 includes a base 12 having a longitudinal axis 14 and longitudinally opposing ends 16 and 18. A pair of blades 20 and 22 extend from base end 18 so as to terminate in respective end portions 20*a* and 22*a,* which converge to a tip 24 aligned with axis 14. Tip 24 is preferably rounded, rather than having a sharp edge, in order to avoid damage at the junction between a ceiling and wall (as shown in FIG. 7), and to increase the effective cutting areas of end portions 20*a* and 22*a* adjacent to tip 24. As is further shown in FIG. 1, blades 20 and 22 have respective inner surfaces which define an open space 26 therebetween open space 26 extends from base end 18 to tip 24.

Blades 20 and 22 are preferably integral with base end 18, such that scraper head 10 is integrally formed as a single piece. Most preferably, scraper head 10 is molded from a suitably sturdy plastic, such as nylon. To increase its resistance to wear, a reinforcing additive can be provided in the nylon.

Figure 2:
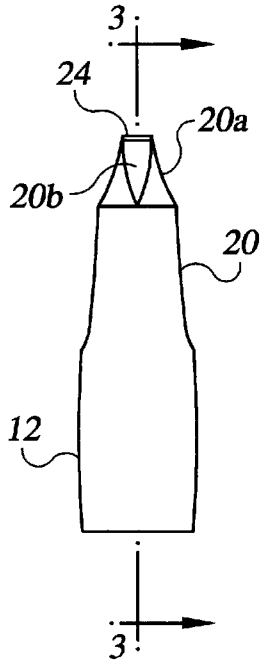
FIG. 2 is a side view of the scraper head shown in FIG. 1, but rotated 90° from the view of FIG. 1.

The view of FIG. 2 shows base 12, blade 20, and its end portion 20*a*. FIG. 2 further shows end portion 20*a* as having an outer surface with a flat area 20*b* extending along the length thereof to tip 24. The purpose of flat area 20*b* will be explained further below. The other blade and its end portion also has a similar flat area, which is not visible in FIG. 2.

Figure 3:
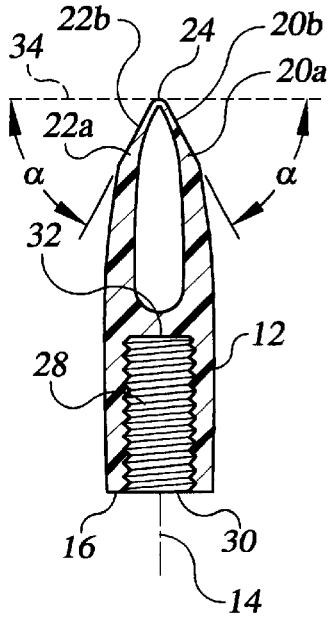
FIG. 3 is a cross-sectional view of the scraper head as viewed along line 3—3 in FIG. 2.

Referring to FIG. 3, this cross-sectional view shows base 12 as having an interior threaded surface defining a longitudinally extending cavity 28. Cavity 28 has an open end 30 at base end 16 and a closed end 32 within base 12. Cavity 28 is coaxially positioned within base 12 such that closed end 32 is longitudinally aligned with and positioned between open end 30 and tip 24. FIG. 3 further shows that each of flat areas 20*b* and 22*b* defines an angle $\alpha$ with respect to a line 34 perpendicular to axis 14. Angle $\alpha$ is preferably about 50–70°, and most preferably about 60°.

Figure 4:
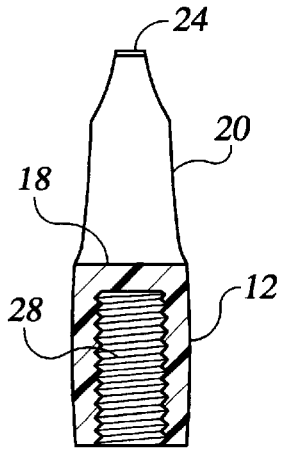
FIG. 4 is a cross-sectional view of the scraper head as viewed along line 4–4 in FIG. 1.

Referring to FIG. 4, this cross-sectional view also shows cavity 28 within base 12, as well as the inner surface of blade 20 extending between base end 18 and tip 24.

Figure 5:
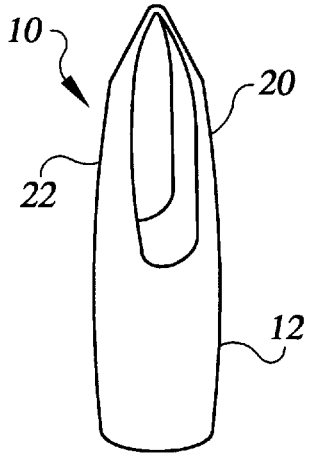
FIG. 5 is a perspective view of the scraper head.
Figure 6:
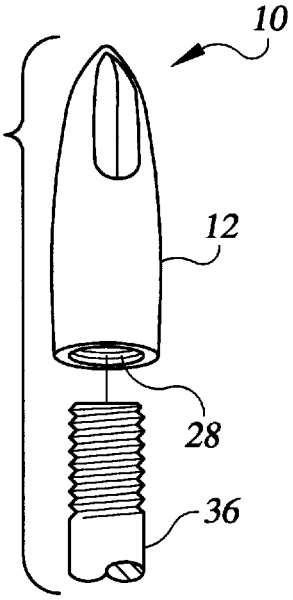
FIG. 6 is another perspective view of the scraper head as well the threaded end portion of an extension pole, as adapted to be threadedly received within the scraper head.

Referring to FIG. 5, this FIGURE provides a perspective view of scraper head 10 comprising base 12 and the pair of blades 20 and 22. The generally cylindrical shape of base 12 is clearly shown in FIG. 5. FIG. 6 shows a different perspective view of scraper head 10 as well as an externally threaded end portion of extension pole 36. Such end portion is adapted to be threadedly received in cavity 28 as defined within base 12. Extension pole 36 can be a standard paint roller extension pole.

Preferred dimensions for scraper head 10 are as follows for the sake of illustration, but should not be construed to limit the invention in any manner: diameter of base ends 16 and 18—1 1/16 inch; longitudinal distance between base ends 16 and 18—1¾ inch; longitudinal distance between base end 18 and inner surface of tip 24—1 15/16 inch; thickness of tip 24 as measured longitudinally between its inner surface and outer surface—1/16 inch; radius of circularly rounded tip 24—1/16 inch; longitudinal distance between lower edges of blade end portions (20*a* and 22*a*) and outer surface of tip 24—⅝ inch; and angle $\alpha$—60°.

Referring to FIG. 7, this FIGURE shows the scraping tool, comprising extension pole 36 and scraper head 10 secured to the end portion thereof, in use along junction 38 between textured ceiling 40 and wall 42. Tip 24 is positioned at junction 38, with blade end portion 22*a* being adjacent to ceiling 40 and blade end portion 20*a* being below blade 22 and adjacent to wall 42. Scraper head 10 is moved with extension pole 36 in a direction parallel to and along junction 38, as indicated by the arrow at 44. Accordingly, blade end portions 20*a* and 22*a* cut away excess texture material, which forms the irregular line to the right of such end portions, to thereby create the straight line at junction 38 to the left of the end portions. Much of the texture material as cut and removed by the blade end portions will pass into open space 26 before falling away. As shown, extension pole 36 is angularly oriented with respect to ceiling 40 and wall 42 during movement of the scraping tool. Extension pole 36 is usually held by the user at an angle of about 45° with respect to wall 42, but this angle can vary somewhat during the scraping process.

The straight line as created by the scraping tool is aesthetically pleasing, and makes it easy to paint the wall adjacent to and along the junction between the ceiling and wall.

In an alternative use of the scraping tool not shown in the drawings, extension pole 36 can be oriented by the user to place either of flat areas 20*a* or 20*b* (depending on the orientation of scraper head 10) in flush contact with wall 42. Scraper head 10 and such flat area can then be moved over wall 42 to remove any unwanted texture material therefrom. During application of texture material to a ceiling, some of such material is often spattered or otherwise dropped on an adjacent wall.

Obviously, many modifications and variations of the present invention are possible in light of the above teachings. It is, therefore, to be understood that within the scope of the appended claims, the invention can be practiced otherwise than as specifically described.

That which is claimed is:

1. A tool for scraping along the junction between a ceiling and wall, said tool comprising a scraper head which includes (i) a base having a longitudinal axis, longitudinally opposing first and second ends, and an interior threaded surface defining a longitudinally extending cavity within the base, the cavity having an open end at the first base end and a closed end within the base, and (ii) a pair of blades extending from the second base end so as to terminate in respective end portions which converge to a tip aligned with said axis.

2. A tool as recited in claim 1 wherein the blades are integral with the second end of the base, such that the scraper head is integrally formed as a single piece.

3. A tool as recited in claim 2 wherein the cavity is coaxially positioned within the base.

4. A tool as recited in claim 3 wherein the closed end of the cavity is longitudinally aligned with and positioned between its open end and the tip.

5. A tool as recited in claim 4 wherein the blades have respective inner surfaces which define an open space therebetween.

6. A tool as recited in claim 5 wherein the open space extends from the second base end to the tip.

7. A tool as recited in claim 6 wherein the end portion of each blade has an outer surface with a flat area extending along the length thereof to the tip.

8. A tool as recited in claim 7 wherein each flat area defines an angle of about 50–70° with respect to a line perpendicular to said axis.

9. A tool as recited in claim 7 wherein the tip is rounded.

10. A tool as recited in claim 9 wherein the scraper head is comprised of a plastic material.

11. A tool as recited in claim 1 further comprising an extension pole having an externally threaded end portion adapted to be threadedly received in the cavity.

12. A method of scraping excess texture material from and along the junction between a textured ceiling and a wall, comprising:

providing a scraping tool comprising a scraper head which includes (i) a base having a longitudinal axis, longitudinally opposing first and second ends, and an interior threaded surface defining a longitudinally extending cavity within the base, the cavity having an open end at the first base end and a closed end within the base, and (ii) a pair of blades extending from the second base end so as to terminate in respective end portions which converge to a tip aligned with said axis, the scraping tool further comprising an extension pole having an externally threaded end portion threadedly received in the cavity;

positioning the tip of the scraper head at the junction between the ceiling and wall, with the end portion of one blade being adjacent to the ceiling and the end portion of the other blade being below said one blade and adjacent to the wall; and moving the scraper head with the extension pole in a direction parallel to and along said junction, whereby the end portions of the blades cut away excess texture material to create a straight line at said junction.

13. A method as recited in claim 12 wherein during movement of the scraping tool, the extension pole is angularly oriented with respect to the ceiling and wall.

* * * * *